US011576496B2

(12) United States Patent
Zhu

(10) Patent No.: US 11,576,496 B2
(45) Date of Patent: Feb. 14, 2023

(54) TENSIONING MECHANISM FOR A COT AND A COT THEREOF

(71) Applicant: Ningbo Huayu Outdoor Products Co., Ltd., Ninghai County (CN)

(72) Inventor: Feijun Zhu, Ninghai County (CN)

(73) Assignee: Ningbo Huayu Outdoor Products Co., Ltd., Zhejiang (CN)

( * ) Notice: Subject to any disclaimer, the term of this patent is extended or adjusted under 35 U.S.C. 154(b) by 0 days.

(21) Appl. No.: 17/446,913

(22) Filed: Sep. 3, 2021

(65) Prior Publication Data

US 2022/0225782 A1 Jul. 21, 2022

(30) Foreign Application Priority Data

Jan. 20, 2021 (CN) ..... 202110074755.6

(51) Int. Cl.
*A47C 17/66* (2006.01)
*A47C 17/64* (2006.01)

(52) U.S. Cl.
CPC ..... *A47C 17/66* (2013.01); *A47C 17/645* (2013.01)

(58) Field of Classification Search
CPC ..... A47C 17/64; A47C 17/645; A47C 17/68; A47C 17/70; A47C 17/705; A47C 17/72; A47C 17/74; A47C 17/76; A47C 17/78; A47C 17/80
See application file for complete search history.

(56) References Cited

U.S. PATENT DOCUMENTS 10,888,172 B2 * 1/2021 Xia ..... A47C 27/081
11,076,702 B2 * 8/2021 Zhang ..... A47C 17/645
2014/0115780 A1 * 5/2014 Lah ..... A47C 19/12 5/111

FOREIGN PATENT DOCUMENTS

CN 210748295 * 6/2020

OTHER PUBLICATIONS

CN210748295 Translation (Year: 2020).*

* cited by examiner

*Primary Examiner* — David R Hare
*Assistant Examiner* — Amanda L Bailey
(74) *Attorney, Agent, or Firm* — Wang Law Firm, Inc.

(57) ABSTRACT

A canvas tensioning mechanism for a cot has a support component (2) which has a first support rod (21) and a second support rod (22) respectively extending toward two sides of the canvas; a fixed fastener (3) is disposed on the top of the first support rod (21) and is capable of being buckled on one of the two side rods (1); a movable fastener (4) is rotatably disposed on the top of the second support rod (22) and is capable of being buckled on the other side rod (1). A leisure bed has a piece of canvas, two side rods and at least two canvas tensioning mechanisms. The canvas tensioning mechanism can easily tension and mount the canvas by a small force, and is convenient to tension the canvas and high in tightness.

7 Claims, 5 Drawing Sheets

TENSIONING MECHANISM FOR A COT AND A COT THEREOF

TECHNICAL FIELD OF THE INVENTION

The present invention relates to the technical field of leisure goods, and in particular to a tensioning mechanism for a cot and a cot.

BACKGROUND OF THE INVENTION

Due to their characteristics of easy storage, convenient use, small space occupation during storage and transportation and the like, leisure beds are very popular among field workers, campers and office workers. When in need of rest, leisure beds are quickly mounted for rest.

In both Chinese Patent CN210715436U (patent NO.: 201921648719.0) titled "CONNECTING PIECE AND LEISURE BED USING THE SAME" and Chinese Patent CN210461320U (patent NO.: 201921147797.2) entitled "CONNECTING PIECE AND LEISURE BED USING THE SAME", the canvas of the disclosure leisure bed needs to be tensioned by support rod components and fasteners connected to ends of the support rod components. In these leisure bed structures, the canvas is tensioned mainly by setting the length of the support rods and the opening direction of the fasteners. In addition, during mounting the fasteners, since the fastening of the fasteners and canvas side rods can be realized only when the canvas is in a tensioned state, a larger force is required for operation. Therefore, for a weak person, it is difficult to mount the leisure bed. Or, in order to meet the user's convenience in tensioning the canvas, generally, in the design of support rods, the distance between support rods on two sides will be reduced, ensuring that the user can better mount the canvas. However, the tightness of the canvas after being unfolded will be reduced, so that the middle part of the canvas is collapsed. As a result, the canvas has a poor supporting effect on the human body, and the user experience is not good.

SUMMARY OF THE INVENTION

It is a first object of the present invention to provide a tensioning mechanism for a cot, which can easily tension and mount the canvas by a small force.

It is a second object of the present invention to provide a cot which is convenient to tension the canvas and high in tightness.

For achieving the first object, the tensioning mechanism for a cot, two side rods disposed at two sides of the canvas, the tensioning mechanism comprising a support component, a fixed fastener, and a movable fastener; wherein, the tensioning mechanism is set to receive two side rods;

the support component has a first support rod and a second support rod each having a top, respectively extending toward two sides of the canvas;

the fixed fastener is disposed on the top of the first support rod and is capable of being buckled on one of the two side rods; and the movable fastener is rotatably disposed on the top of the second support rod and is capable of being buckled on the other side rod; and the movable fastener is capable of rotating in a direction which increases tension on the canvas and clamping the second support rod after the canvas is stretched.

In order to make the structure simple, preferably, the movable fastener comprises a main body rotatably connected to the second support rod and a buckling portion connected to the top of the main body; and the buckling portion has a clamping groove for receiving the side rod; the main body has an accommodating groove for receiving the second support rod, and the main body is limitedly clamped with the second support rod after the canvas is tensioned.

In order to make the structure simple, preferably, a plurality of elastic limiting protrusions keeping moving toward the sidewall of the accommodating groove are disposed on the second support rod, correspondingly, the main body has a plurality of limiting holes located on the sidewall of the accommodating groove for receiving the limiting protrusions.

In order to ensure the stability of buckling the fasteners onto the second support rods, preferably, the main body has two staggered limiting holes facing each other, and two limiting protrusions are respectively disposed on left and right side of the second support rod.

In order to ensure the elastic movement range of the limiting protrusions, preferably, the two limiting protrusions on the second support rod are located at different heights.

In order to more conveniently release the limiting connection of the moving fasteners on the second support rods, preferably, a plurality of operating members are movably disposed inside the limiting holes so as to push the corresponding limiting protrusion to move along the limiting hole.

For convenience of mounting, preferably, the second support rod is a hollow pipe, and a mounting block for receiving the elastic limiting protrusions is disposed inside the second support rod; the mounting block has a plurality of mounting recesses for receiving the elastic limiting protrusions, and an elastic piece is disposed inside each mounting recess resisting each limiting protrusion to make the each limiting protrusion protruding out of the second support rod.

Preferably, the main body has a plurality of inclined guide surfaces for guiding the limiting protrusions to enter into the limiting holes disposed corresponding to the limiting holes.

For achieving the second object, the cot comprises a piece of canvas and two side rods disposed at two sides of the canvas; wherein, the bed further comprises at least two canvas tensioning mechanisms, which are disposed along a lengthwise direction of the canvas.

Preferably, for more convenience of mounting, the movable fasteners of the canvas tensioning mechanisms are disposed on the same side.

Compared with the prior art, in the tensioning mechanism and the cot thereof provided by the present invention, by the rotatable connection of the moving fasteners relative to the second support rods, during the tensioning operation of the canvas, the canvas changes from a relaxed state to a tensioned state. During the operation process, the canvas can be easily tensioned by a small force. Moreover, the tightness of the bet fabric is better, and the supporting effect on the user is better. In addition, the operation process is simple and convenient and has relatively low requirements for the operator's force, so that the popularity is higher.

DETAILED DESCRIPTION OF THE INVENTION

The present invention will be further described in detail by embodiments with reference to the accompanying drawings.

The canvas tensioning mechanism for a cot in this embodiment can be applied in various leisure bends. In this embodiment, by taking a cot as an example, the canvas tensioning mechanism and the cot thereof in the present invention will be described below, respectively.

Figure 1:
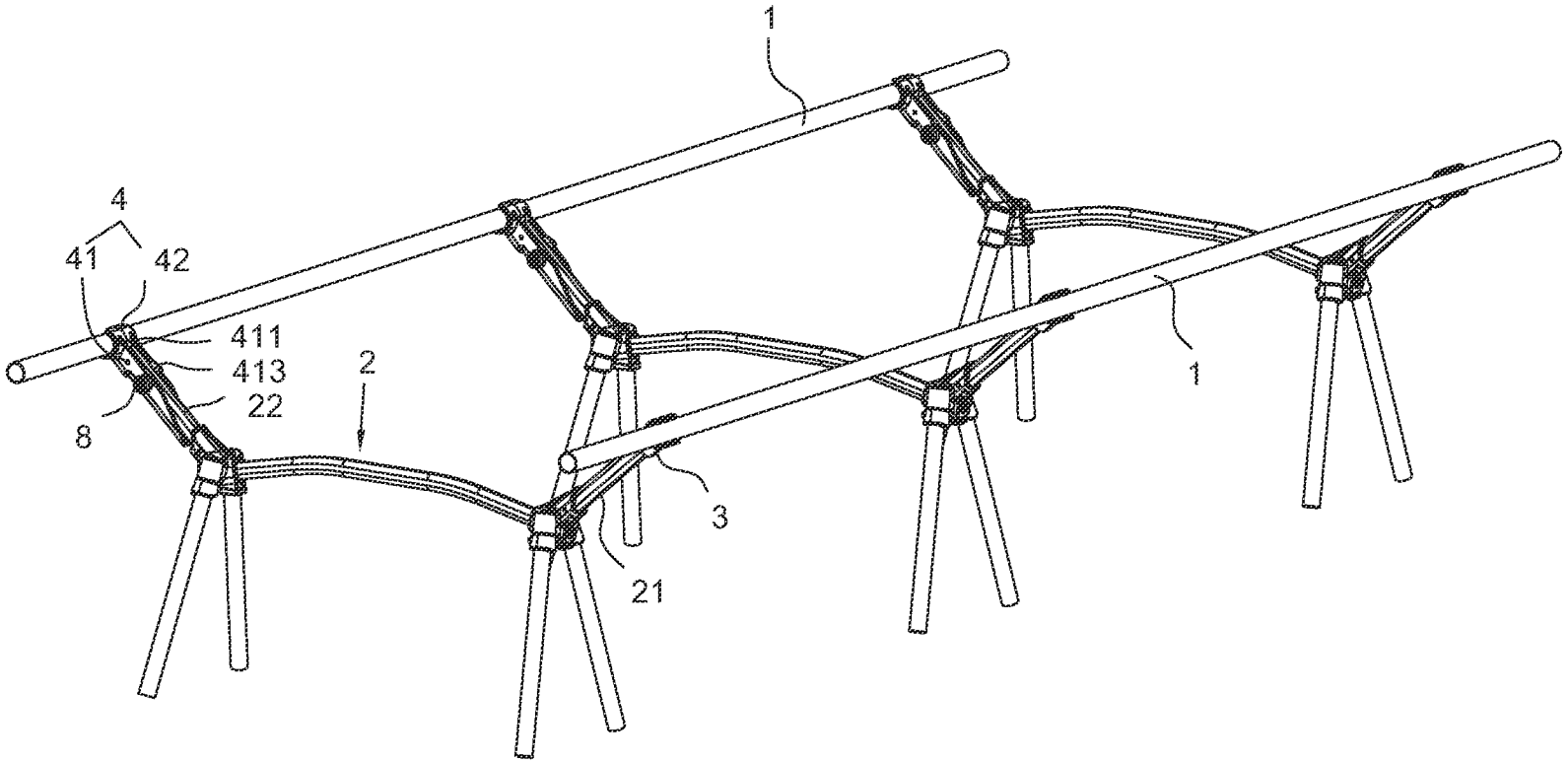
FIG. 1 is a perspective view of a cot according to an embodiment of the present invention.
Figure 2:
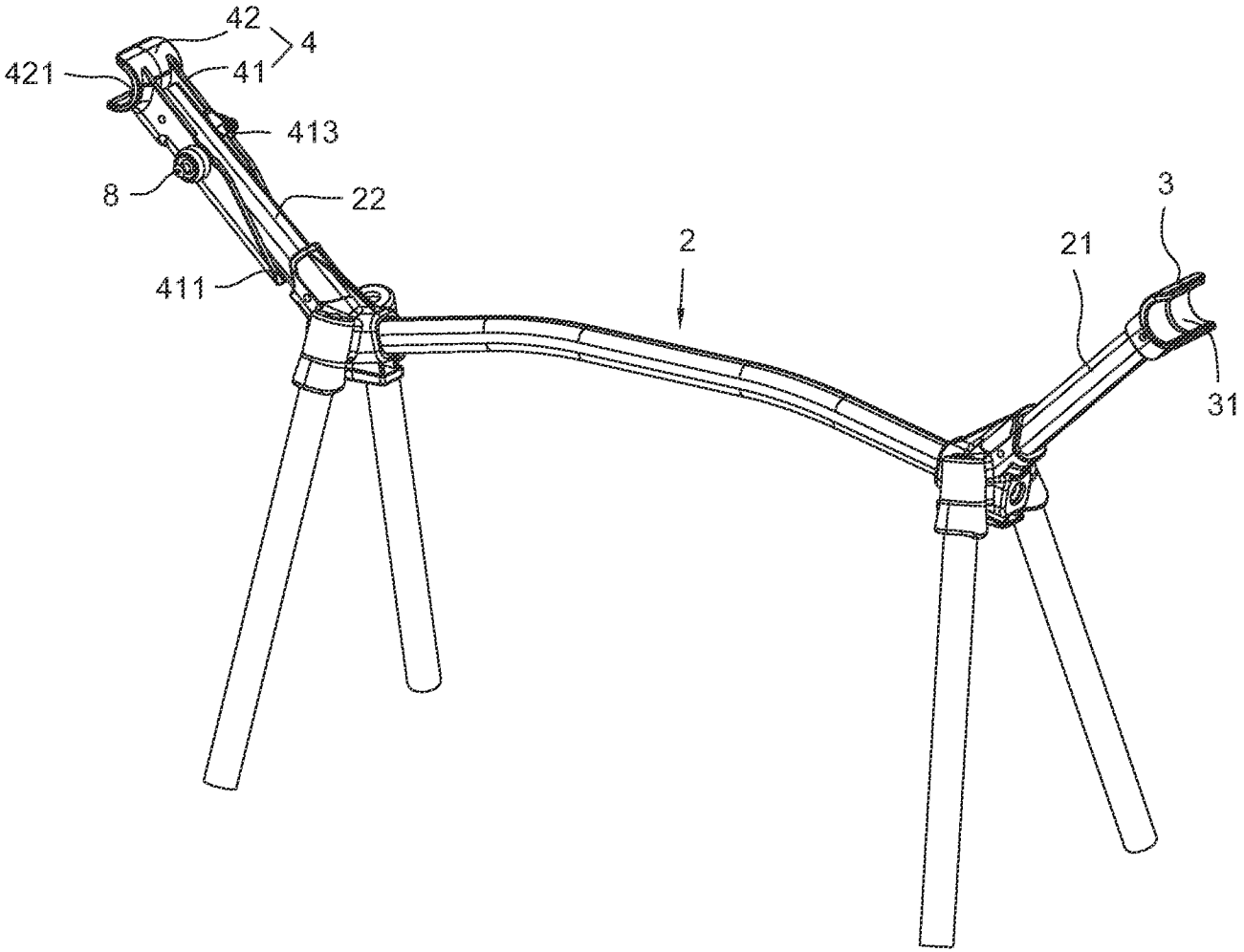
FIG. 2 is a perspective view of a tensioning mechanism in a tensioned state according to the embodiment of the present invention.
Figure 3:
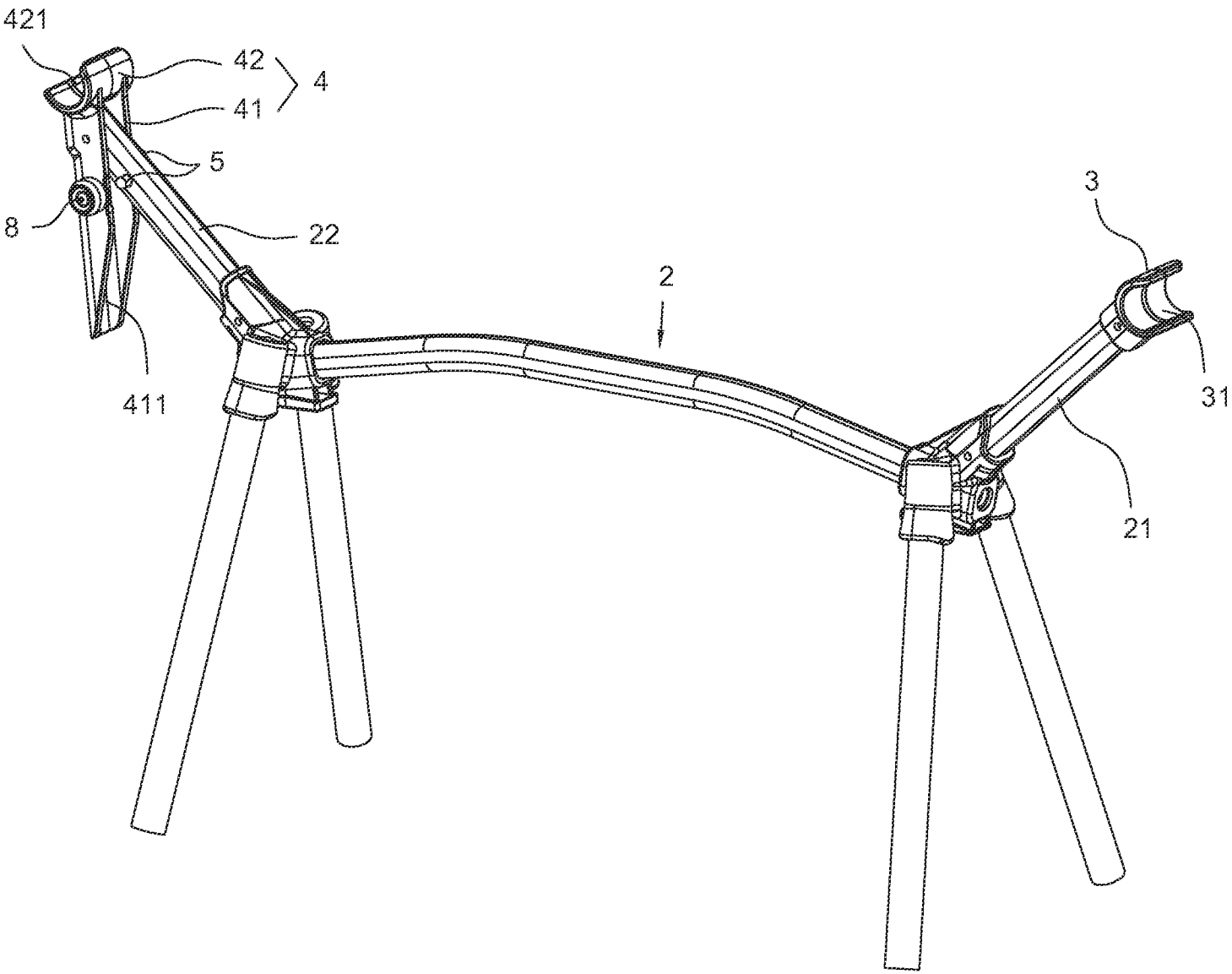
FIG. 3 is a perspective view of the tensioning mechanism in a non-tensioned state according to the embodiment of the present invention.

As shown in FIG. 1, the cot in this embodiment comprises a piece of canvas (not shown), two side rods 1 disposed at two sides of the canvas, and at least two tensioning mechanisms, which are disposed along a lengthwise direction of the canvas. As shown in FIGS. 1-3, each tensioning mechanism for the cot comprises a support component 2, a fixed fastener 3 and a movable fastener 4.

As shown in FIGS. 1-3, the support component 2 may be the support component in the prior art. In this embodiment, the support component 2 comprises two connecting pieces disposed in a widthwise direction of the canvas, a connecting rod connected between the two connecting pieces, and two support rods connected to the connecting pieces. The two support rods respectively extent toward two sides of the canvas. For convenience of description, it is defined that one support rod is a first support rod 21 and the other support rod is a second support rod 22. According to the height requirements of the cot, support legs can be additionally connected to the connecting pieces.

The fixed fastener 3 can be fixedly connected the top of the support rod 21 and can be set to receive one of the two side rods 1. In this embodiment, the fixed fastener 3 is connected to the first support rods 21 in an insertion manner. A clamping groove 31 for receiving the side rod 1 is disposed on the fixed fastener 3. During mounting, the clamping groove 31 on the fixed fastener 3 is aligned with the side rod 1, so that the clamping connection between the fixed fastener 3 and the side rod 1 is realized.

Figure 4:
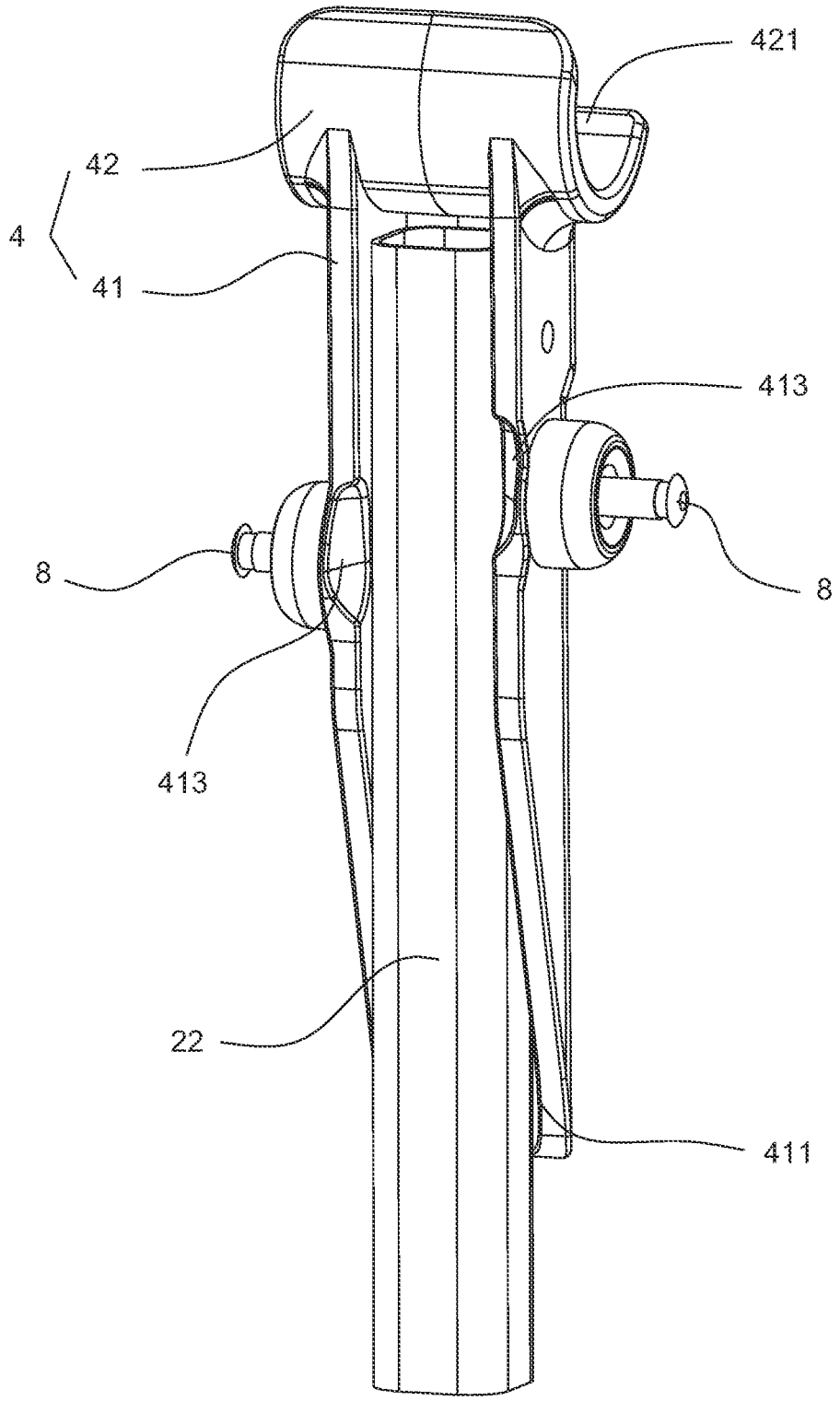
FIG. 4 is a perspective view of the connection between a second support rod and a moving fastener according to the embodiment of the present invention.
Figure 5:
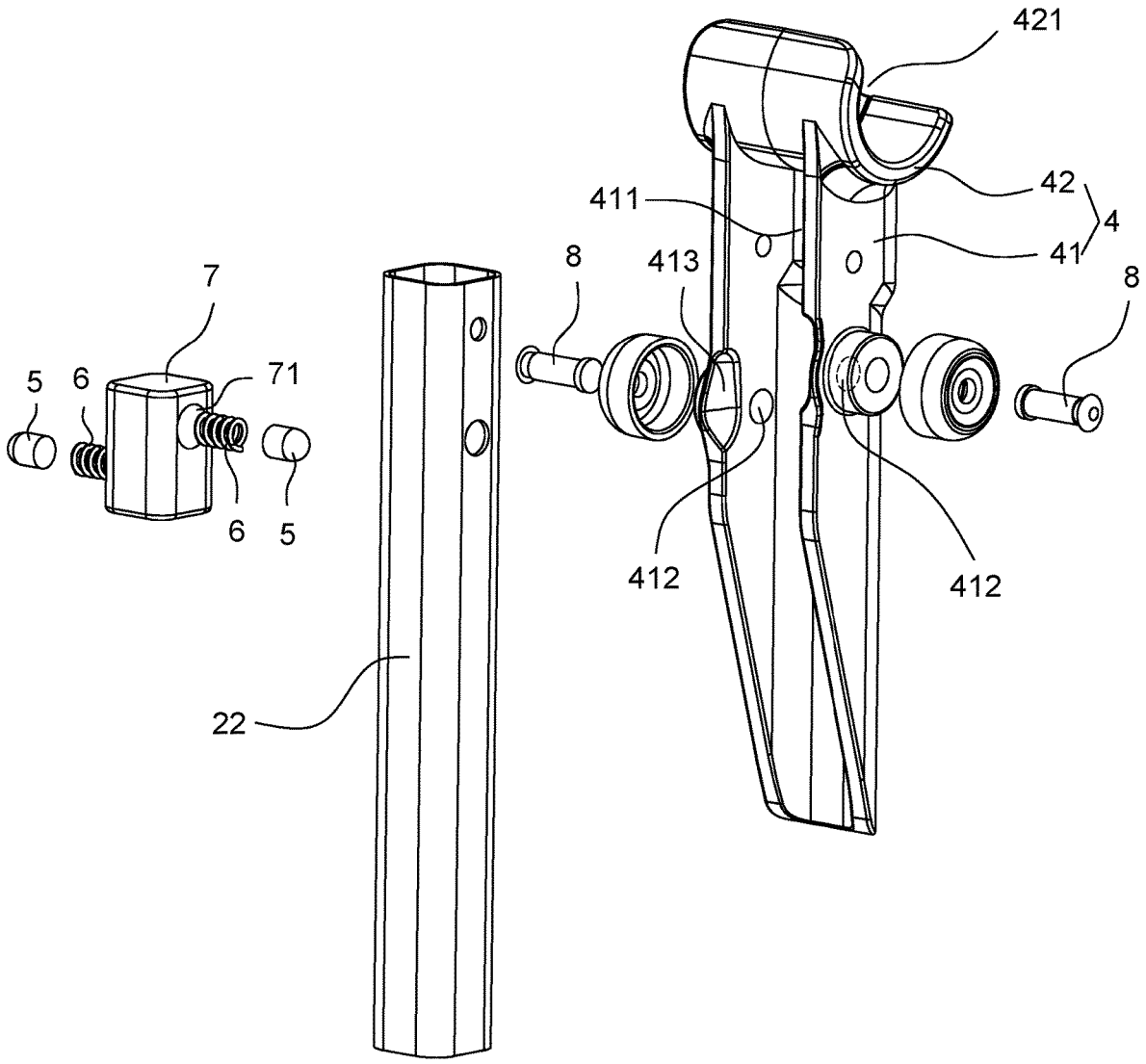
FIG. 5 is an exploded view of FIG. 3.

As shown in FIGS. 4-5, the movable fastener 4 is rotatably disposed on the top of the second support rod 22 and is capable of being set to receive the other side rod 1; and the movable fastener 4 is capable of rotating in a direction which increases tension on the canvas and clamping the second support rod 22. Specifically, the movable fastener 4 comprises a main body 41 rotatably connected to the second support rod 22 and a buckling portion 42 connected to the top of the main body 41. The buckling portion 42 has a clamping groove 421 for receiving the side rod 1; the main body 41 has an accommodating groove 411 for receiving the second support rod 22, and the accommodating groove 411 is opened facing the second support rod 22. The upper end of the main body 41 is rotatably connected to the second support rod 22 and clamps the second support rod 22 after the canvas is tensioned.

The clamping structure of the main body 41 and the second support rod 22 is as follows: two elastic limiting protrusions 5 keeping moving toward the sidewall of the accommodating groove 411 are disposed on the second support rod 22, correspondingly, the main body 41 has two staggered limiting holes 412 located on the sidewall of the accommodating groove 411 for receiving the limiting protrusions 5. In order to ensure connection stability, the limiting protrusions 5 are disposed on two opposite side faces of the second support rod 22. For convenience of mounting, the second support rod 22 is a hollow pipe, and a mounting block 7 for receiving the elastic limiting protrusions 5 is disposed inside the second support rod 22; the mounting block 7 has two mounting recesses 71 for receiving the elastic limiting protrusions 5, and an elastic piece 6 is disposed inside each mounting recess 71 pushing each limiting protrusion 5 to protrude out of the second support rod 22. Since the radial distance between the second support rods 22 is very limited, in order to ensure the elastic movement range of the limiting protrusions 5, the two limiting protrusions 5 on the second support rod 22 are located at different heights. The main body 41 has two correspondingly staggered limiting holes 412 facing each other. Under the action of the elastic pieces 6, the limiting protrusions 5 on the second support rod 22 can insert into the limiting holes 412, so as to realize the limiting connection between the moving fastener 4 and the second support rod 22.

In addition, in order to more conveniently release the limiting connection of the moving fastener 4 on the second support rod 22, two operating members 8 are movably disposed inside the limiting holes 412 so as to push the corresponding limiting protrusion 5 to move along the limiting hole 412. In this embodiment, the operating members 8 are rods. Two limiting sheets are extended radially outward from two ends of the rods in the circumferential direction. The inner walls of the corresponding limiting holes 412 are disposed in a step shape, and the diameter of the inner sides of the limiting holes 412 is greater than that of their outer sides, so that the operating members 8 are limited into the limiting holes 412 by the step portions of the limiting holes 412, and the operating members 8 are prevented from falling off from the limiting holes 412. Moreover, the limiting connection to the limiting holes 412 is realized without affecting the inserting of the limiting protrusions 5 into the limiting holes 412.

In addition, in order to more smoothly insert the limiting protrusions 5 into the limiting holes 412 when the movable fastener 4 is set to receive the second support rod 22, in this embodiment, the main body 41 has two inclined guide surfaces 413 for guiding the limiting protrusions 5 to enter into the limiting holes 412 disposed corresponding to the limiting holes 412. Due to the guidance of the guide surfaces 413, the limiting protrusions 5 can more smoothly insert into the limiting holes 412, so that the damping during operation is reduced, and the operation is more labor-saving.

In addition, in this embodiment, the movable fastener 4 is connected to the second support rod 22 through connecting shafts. Since the movable fastener 4 is small relative to the second support rod 22, for convenience of assembly, the movable fastener 4 is already rotatably connected to the second support rod 22 when leaving the factory, avoiding the situation that the user cannot find a suitable tool for this connection. The second support rod 22 on different support component 2 may be connected on the same side of the canvas or may be connected on different sides of the canvas. In this embodiment, for convenience of assembly, the second support rod 2 on different support component 2 is located on the same side of the canvas, that is, the movable fastener 4 of the canvas tensioning mechanisms is disposed on the same side.

The method of using the canvas tensioning mechanism for a cot is described below. When a cot needs to be used, the support component 2 in the tensioning mechanisms is assembled firstly, and the fixed fastener 3 is then set to receive the tops of the first support rod 21 of the support component 2. Since the movable fastener 4 is usually already connected to the second support rod 22 when leaving the factory, it is unnecessary to rotatably connect the movable fastener 4 to the second support rod 22. However, before mounting the canvas, the movable fastener 4 is not in limited connection to the second support rod 22, that is, the second support rod 22 is not set to receive the accommodating groove 411 on the main body 41 of the movable fastener 4 through the limiting protrusions 5. Then, the fixed fastener 3 is disposed on the side rod 1 on one side of the canvas, and the buckling portion 42 of the movable fastener 4 is set to receive the side rod 1 on the other side of the canvas. The main body 41 of the movable fastener 4 is pushed toward the second support rod 22, so that the buckling portion 42 of the movable fastener 4 is rotated in a direction of tensioning of the canvas. As the main body 41 of the movable fastener 4 is pushed continuously, the tightness of the canvas is increased continuously. After the tightness of the canvas reaches the designed maximum tightness, the limiting protrusions 5 on the second support rod 22 are just clamped into the limiting holes 412 on the main body 41 of the movable fastener 4 due to the elastic pressure of the elastic piece 6, so that the operating members 8 are pushed outward and protruded out of the movable fastener 4. The limiting connection between the second support rod 22 and the movable fastener 4 is realized by fitting the limiting protrusions 5 with the limiting holes 412. At this time, the movable fastener 4 cannot rotate relative to the second support rod 22, so that the current tensioned state of the bed fabric is maintained, and the cot can be used at this time. During this process, the required operating force is small, and the operation is very convenient.

When the cot needs to be folded, the user presses the operating members 8, and the operating members 8 press the limiting protrusions 5 inward. At this time, the elastic pieces 6 are in a compressed state, and the limiting protrusions 5 fall off from the limiting holes 412. Then, the second support rod 22 and the movable fastener 4 are operated in a separation direction, so that the second support rod 22 falls off from the accommodating groove 411 on the main body 41 of the movable fastener 4. Correspondingly, the canvas changes from the tensioned state to the relaxed state due to the rotation of the movable fastener 4. The fixed fastener 3 and the movable fastener 4 are detached from the side rods 1 on two sides of the canvas, and the canvas, the side rods 1, the support component 2 and the fixed fastener 3 are disassembled for storage, respectively.

In the canvas tensioning mechanism and the cot thereof provided by the present invention, by the rotatable connection of the movable fastener 4 relative to the second support rod 22, during the tensioning operation of the canvas, the canvas changes from a relaxed state to a tensioned state. During the operation process, the canvas can be easily tensioned by a small force. Moreover, the tightness of the bet fabric is better, and the supporting effect on the user is better. In addition, the operation process is simple and convenient and has relatively low requirements for the operator's force, so that the popularity is higher.

The invention claimed is:

1. A canvas having a tensioning mechanism for a cot, the cot comprising two side rods (1) disposed at two sides of the canvas, the tensioning mechanism comprising a support component (2), a fixed fastener (3), and a movable fastener (4);

wherein, the tensioning mechanism is configured to receive the two side rods (1);

the support component (2) has a first support rod (21) and a second support rod (22) each having a top, respectively extending toward two sides of the canvas;

the fixed fastener (3) is disposed on the top of the first support rod (21) and is configured to be buckled on one of the two side rods (1);

the movable fastener (4) is rotatably disposed on the top of the second support rod (22) and is configured to be buckled on the other of the two side rods (1); and the movable fastener (4) is configured to rotate in a direction which increases tension on the canvas and causes clamping on the second support rod (22); wherein the movable fastener (4) comprises a main body (41) rotatably connected to the second support rod (22) and a buckling portion (42) connected to the top of the main body (41);

the buckling portion (42) has a clamping groove (421) for receiving the side rod (1);

the main body (41) has an accommodating groove (411) for receiving the second support rod (22), and the main body (41) clamps on the second support rod (22) after the canvas is tensioned;

first and second elastic limiting protrusions (5) respectively biased towards opposing sidewalls of the accommodating groove (411) are disposed on the second support rod (22), correspondingly, the main body (41) has first and second staggered limiting holes (412) respectively located on the opposing sidewalls of the accommodating groove (411) for respectively receiving the first and second limiting protrusions (5)

the second support rod (22) is a hollow pipe, and a mounting block (7) for receiving the elastic limiting protrusions (5) is disposed inside the second support rod (22);

the mounting block (7) has a plurality of mounting recesses (71) for mounting the elastic limiting protrusions (5), and an elastic piece (6) is disposed inside each mounting recess (71) pushing each limiting protrusion (5) to protrude out of the second support rod (22).

2. The tensioning mechanism of claim 1, wherein the first and second limiting holes are (412) facing each other, and the first and second limiting protrusions (5) are respectively disposed on left and right sides of the second support rod (22).

3. The tensioning mechanism of claim 2, wherein the first and second limiting protrusions (5) on the second support rod (22) are located at different heights along the length of the second support rod (22).

4. The tensioning mechanism of claim 1, wherein first and second operating members (8) are movably disposed inside a respective one of the first and second limiting holes (412) so as to push the corresponding limiting protrusion (5) to move along the respective limiting hole (412).

5. The tensioning mechanism of claim 1, wherein the main body (41) has a plurality of inclined guide surfaces (413) for guiding the first and second limiting protrusion (5) to enter into the respective limiting holes (412).

6. A cot, comprising a piece of canvas and two side rods (1) disposed at two sides of the canvas; the cot further comprises at least two canvas tensioning mechanisms of claim 1, which are disposed along a lengthwise direction of the cot.

7. The cot of claim 6, wherein the movable fasteners (4) of the canvas tensioning mechanisms are disposed on a same side of the cot.

* * * * *